US005777462A

United States Patent [19]

Yue

[11] Patent Number: 5,777,462

[45] Date of Patent: Jul. 7, 1998

[54] MODE CONFIGURABLE DC POWER SUPPLY

[75] Inventor: Jingxing Yue, San Diego, Calif.

[73] Assignee: Hughes Electronics Corporation, El Segundo, Calif.

[21] Appl. No.: 689,864

[22] Filed: Aug. 15, 1996

[51] Int. Cl.[6] ..... G05F 1/56; G05F 1/575

[52] U.S. Cl. ..... 323/285; 323/284

[58] Field of Search ..... 323/284, 285, 323/286, 287, 282, 283

[56] References Cited

U.S. PATENT DOCUMENTS

| | | | |
|---|---|---|---|
| 3,758,839 | 9/1973 | Medlar | 320/32 |
| 3,816,804 | 6/1974 | Cardwell, Jr. | 320/33 |
| 4,131,841 | 12/1978 | Bennefeld | 320/32 |
| 5,039,934 | 8/1991 | Banaska | 323/285 |
| 5,470,343 | 11/1995 | Fincke et al. | 607/5 |
| 5,479,090 | 12/1995 | Schultz | 323/284 |
| 5,575,807 | 11/1996 | Faller | 607/5 |
| 5,613,229 | 3/1997 | Baranowski et al. | 323/285 |

*Primary Examiner*—Peter S. Wong
*Assistant Examiner*—Derek J. Jardieu
*Attorney, Agent, or Firm*—John Whelan; Michael Sales

[57] ABSTRACT

A dual mode external DC power supply system for supplying DC power to an electronic device and which operates under the control of the electronic device is provided. The disclosed embodiment of the power supply system includes a first input adapted to receive an input signal of unregulated DC power, a second input adapted to receive a control signal from the electronic device, and an output adapted to provide either a constant voltage DC output signal or a constant current DC output signal depending on the magnitude of the control signal. The control signal also determines the level of constant current delivered to the electronic device when the system is operating in the constant current mode. The disclosed embodiment of the DC power supply system includes a regulating circuit responsive for conditioning the input signal of unregulated DC power into a DC output signal, a voltage sensing circuit adapted to provide a first feedback signal to the regulating circuit, a current sensing circuit also adapted to provide a second feedback signal to the regulating circuit, and a switch responsive to the control signal, for operatively coupling the first feedback signal to the regulating circuit when the system is operating in the constant voltage mode and coupling the second feedback signal when the system is operating in the constant current mode.

9 Claims, 5 Drawing Sheets

MODE CONFIGURABLE DC POWER SUPPLY

BACKGROUND OF THE INVENTION

The present invention relates to regulated power supplies, and more particularly to DC regulated power supplies that are configurable as either a constant voltage power supply or a constant current power supply. Even more particularly, the present invention relates to an external DC power supply system for supplying DC power to an rechargeable portable electronic unit operating under the control of the electronic unit and that can be configured as either a constant voltage power supply or a constant current power supply.

Many portable electronic devices such as mobile communication devices are typically powered by battery power sources, such as Nickel Cadmium or Nickel Metal Hydride Batteries. These battery power sources provide a limited supply of power to the electronic device before being depleted, and then need to be recharged. As a result, many battery powered portable electronic devices are adapted to use both an external constant voltage DC power supply to operate the unit whenever it is not necessary to use the batteries and also use an external constant current DC power supply when it is necessary to recharge the batteries. Both the constant voltage DC power supply system and the constant current power supply system are well known and commonly utilized devices.

For example, in FIG. 1, a schematic diagram is shown of a commonly used prior art system for an external constant voltage power supply that is used to provide operating power to a portable electronic unit. Shown are an constant voltage DC power supply module 10 and a portable electronic device 12 coupled together by a pair of conductors 14,16. The constant voltage DC power supply module 10 is a switching DC/DC step-down power supply adapted for taking an input signal 20 of unregulated DC power and providing an output signal 21 of a constant DC voltage as measured across the pair of conductors 14, 16. Specifically, the DC output signal 21 is passed from power supply module 10 to the portable electronic device 12 via a first conductor 14 whereas the second conductor 16 connects the power supply module 10 and the portable electronic device 12 to a ground reference 17.

The illustrated constant voltage DC power supply module 10 includes the DC input coupled to the emitter of a switching transistor 22, a pulse width modulated controller 24 connected to the base of the switching transistor 22, and a filter circuit including a diode 26, an inductor 28, and a capacitor 30, coupled to the collector of the switching transistor 22. The output DC voltage level is set by a voltage sensing block 32 which provides a feedback signal 34 to the pulse width modulated controller 24. The constant voltage DC power supply also includes a current sensing resistor 36 coupled to a current limiting block 38 which forwards a shutdown signal 40 to the pulse width modulated controller 24 to protect the power supply module 10 in the case of an over-current condition.

Alternatively, in FIG. 2, a schematic diagram is shown of a prior art system for an external constant current power supply that is utilized with many rechargeable electronic devices powered by Nickel Cadmium and Nickel Metal Hydride rechargeable batteries. As seen therein, the constant current power supply module 42 and a rechargeable electronic device 44 are coupled together by a pair of conductors 46, 48, the first of which forwards the constant current output signal to the electronic device while the other conductor 48 is a ground return conductor.

The constant current power supply module 42 is a switching power supply adapted for taking an input signal 50 of DC power and providing an output signal 51 of a constant current used to recharge the batteries in the rechargeable electronic device 44. The constant current power supply module 42 includes the DC input coupled to the emitter of a switching transistor 52, a pulse width modulated controller 54 connected to the base of the switching transistor 52, and a filter circuit including a diode 56, an inductor 58, and a charging capacitor 60, coupled to the collector of the switching transistor 52. The output current level is measured by a current sensing resistor 62 coupled to a current sensing block 64 which provides a feedback signal 66 to the pulse width modulated controller 54 to adjust the on/off duty cycle of the switching transistor 52 thereby setting the output current level. The illustrated constant current power supply also includes a voltage limiting block 68 which forwards a shutdown signal 70 to the pulse width modulated controller 54 to protect the constant current power supply module 42 in the case of an over-voltage condition.

Disadvantageously, the power supply system shown in FIG. 1, does not regulate the output current and thus cannot be used to charge various rechargeable batteries found in many portable electronic devices. Conversely, the power supply system shown in FIG. 2, does not regulate the output voltage. Because the majority of portable electronic devices require the device operating voltage be regulated within prescribed tolerance limits while the current may vary across a relatively large scale, the constant current power supply system should not be used to operate the electronic products but should only be used to recharge the batteries of the electronic device.

Many existing rechargeable portable electronic devices utilize an external DC power supply system that incorporates both a constant voltage mode as well as a constant current mode. Typically these dual mode power supply systems utilize two separate power regulating cores. The first power core is set in a constant voltage mode as shown in FIG. 1, and is used to power the portable electronic unit. The second power core is set in a constant current mode as shown in FIG. 2, and is often used only to charge the batteries in a rechargeable electronic device. A DC power supply system that uses two separate power cores necessarily involves additional components which tend to increase the size, weight, and cost of the power supply system.

To that end, there continues to be a need to develop a relatively compact, low cost and reliable DC power supply system using a single power core for supplying DC power to a rechargeable portable electronic unit that operates in a constant voltage mode or a constant current mode depending on the needs of the portable electronic device.

The present invention advantageously addresses the above and other needs.

SUMMARY OF THE INVENTION

The present invention advantageously addresses the needs above as well as other needs by providing a DC power supply system for supplying DC power to an rechargeable portable electronic unit wherein the power supply is configured so as to operate in a constant voltage mode or a constant current mode with the mode selection being under the control of the portable electronic unit receiving the power.

In accordance with one embodiment, the invention can be characterized as a dual mode external DC power supply system for supplying DC power to an electronic device.

Advantageously, the dual mode DC power supply system operates under the control of the electronic device such that it functions as a constant voltage power supply when the electronic device is operating and functions as a constant current power supply when necessary to recharge the batteries of the electronic device. The first disclosed embodiment of the power supply system includes a first input adapted to receive an input signal of unregulated DC power, a second input adapted to receive a control signal from the electronic device, and an output adapted to provide either a constant voltage DC output signal or a constant current DC output signal depending on the magnitude of the control signal. The control signal also determines the level of constant current delivered to the electronic device when the system is operating in the constant current mode. The first disclosed embodiment of the DC power supply system includes a regulating circuit responsive for conditioning the input signal of unregulated DC power into a DC output signal, a voltage sensing circuit adapted to provide a first feedback signal to the regulating circuit, a current sensing circuit also adapted to provide a second feedback signal to the regulating circuit, and a switch responsive to the control signal, for operatively coupling the first feedback signal to the regulating circuit when the system is operating in the constant voltage mode and coupling the second feedback signal to the regulating circuit when the system is operating in the constant current mode.

In the disclosed embodiments of the DC power supply system, the regulating circuit is comprised of a series switch transistor adapted to receive the input signal of unregulated DC power, a pulse width modulated controller connected to the base of a series switch transistor and adapted to condition the input signal of unregulated DC power into a pulse width modulated signal, and a filtering circuit (including a diode, inductor and apacitor) connected to the series switch transistor and adapted for rectifying the pulse width modulated signal to the DC output signal for delivery to the electronic device. One of the feedback signals originating from either the current sensing circuit or the voltage sensing circuit is selectively coupled to the pulse width modulated controller. The selection of which feedback signal to couple with the pulse width modulated controller is governed the magnitude of the control signal. As indicated above, the control signal is also used as a reference input to the current sensing circuit in order to adjust the level of constant current that is delivered to the electronic device when the system is operating in the constant current mode.

The disclosed embodiments of the DC power supply system further include various safety features such as a voltage limiting circuit adapted for limiting the voltage of the DC output signal to a prescribed maximum voltage when the system is operating in a constant current mode. The voltage limiting circuit forwards a voltage limiting signal to the pulse width modulated controller to protect the power supply in the case of an over-voltage condition. Likewise, there is a current limiting circuit adapted for limiting the current of the DC output signal to a prescribed maximum current when the system is operating in a constant voltage mode. As with the voltage limiting circuit, the current limiting circuit forwards a current limiting signal to the pulse width modulated controller to protect the power supply in the case of an over-current condition.

Advantageously, the presently disclosed dual mode DC power supply system can be easily incorporated within a small rechargeable/portable electronic device where the coupling between the operating electronics and the power supply is internal to the electronic device. Alternatively, the disclosed dual mode DC power supply system can be configured as an external power supply system adapted for external coupling between the portable electronic device and the power supply.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
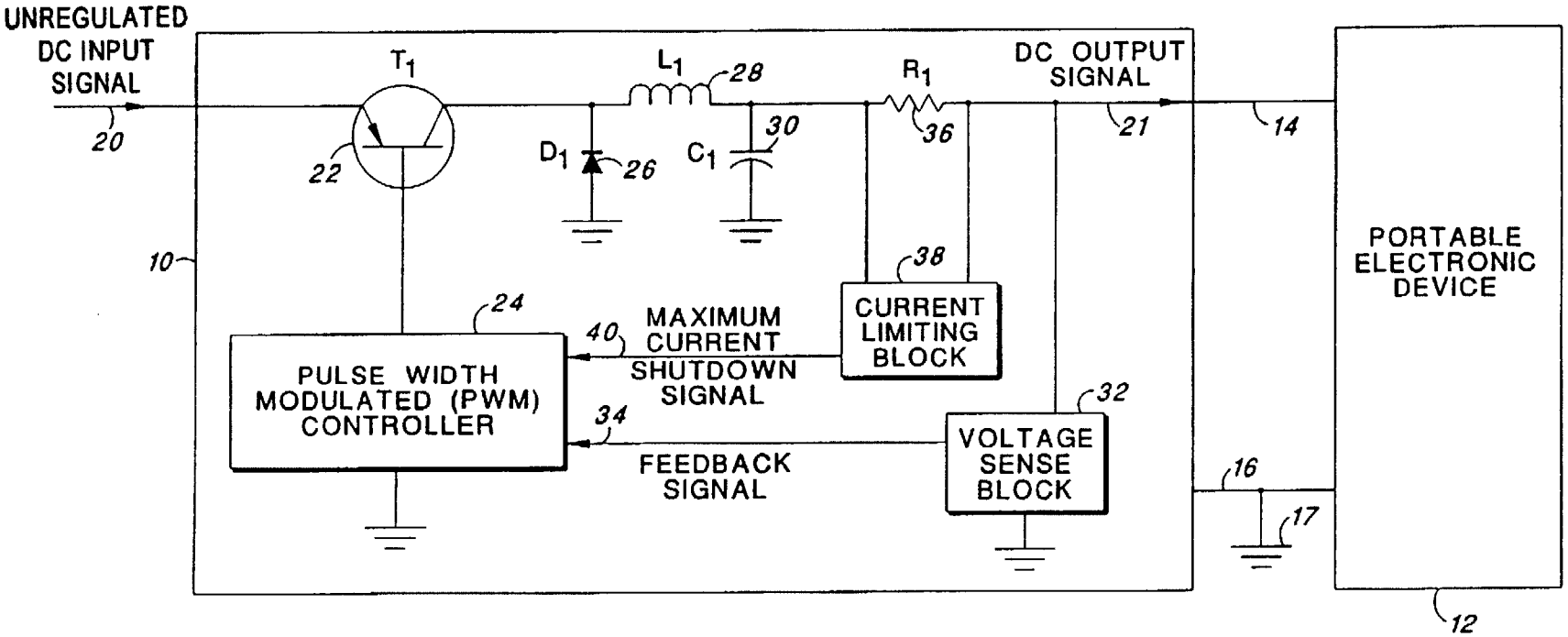
FIG. 1 (PRIOR ART)
FIG. 1 is a schematic diagram of a prior art constant voltage power supply system that is used to provide operating power to a portable electronic device.
Figure 2:
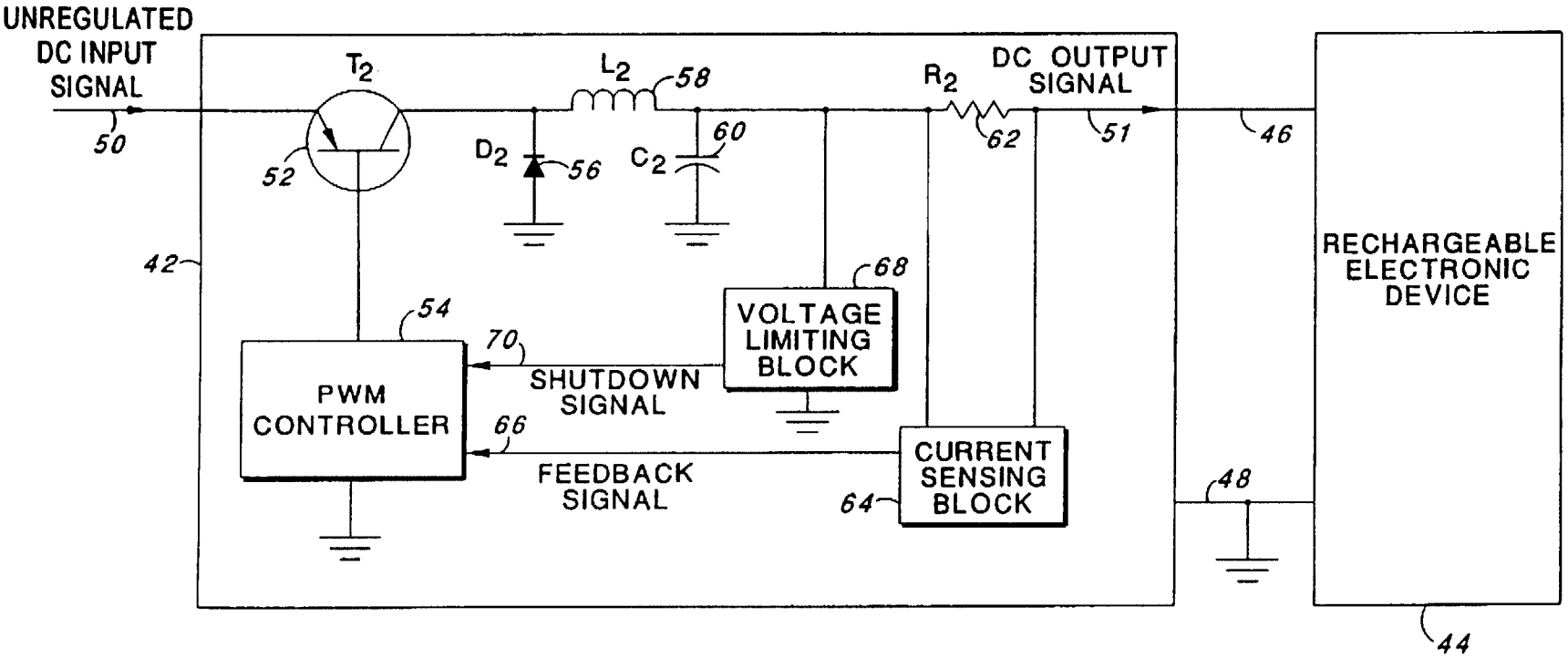
FIG. 2 (PRIOR ART)
FIG. 2 is a schematic diagram of a prior art constant current power supply system that is utilized with many rechargeable electronic devices powered by Nickel Cadmium and Nickel Metal Hydride rechargeable batteries.

FIGS. 1 and 2 are described hereinabove in the section entitled BACKGROUND OF THE INVENTION.

Figure 3A:
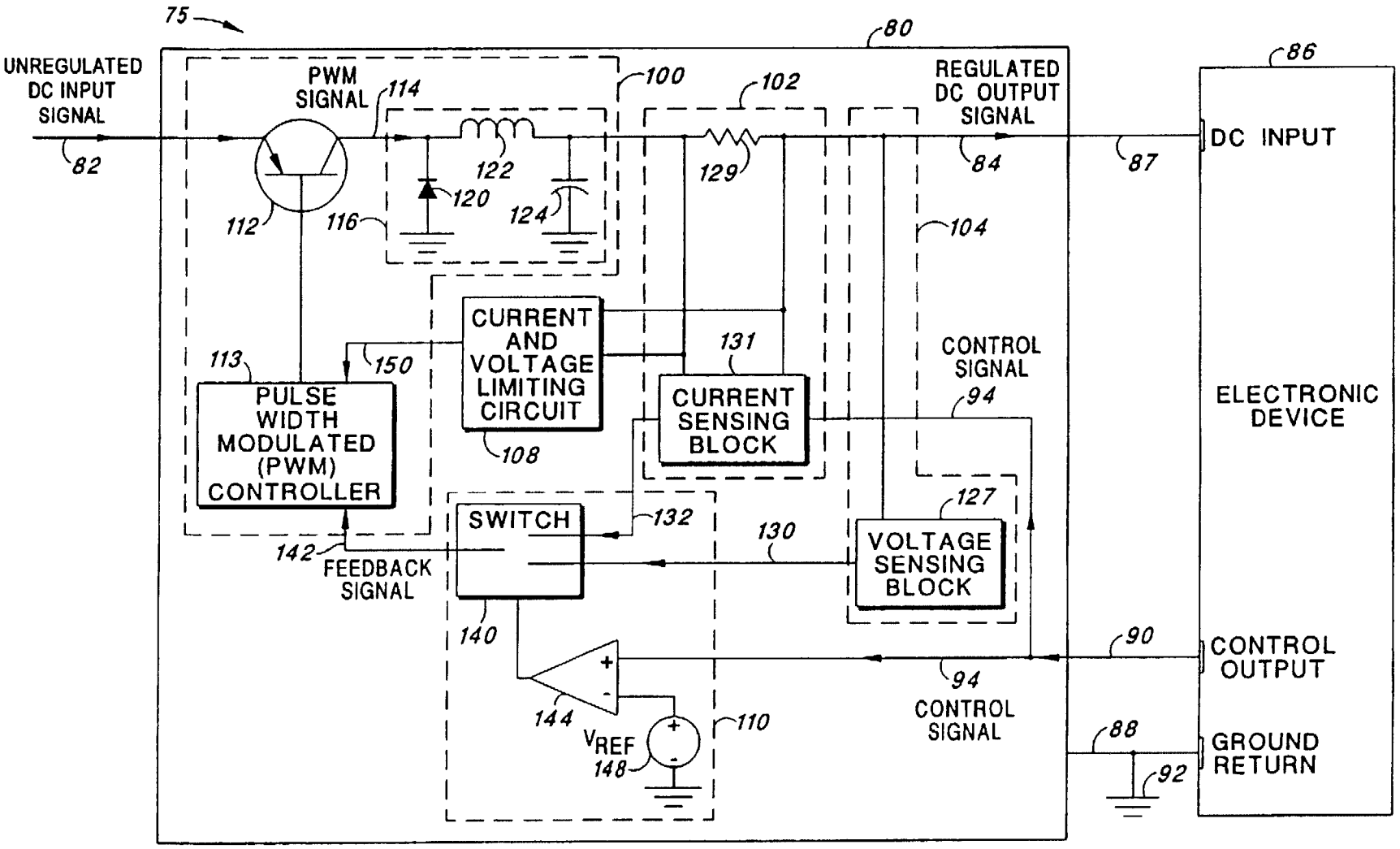
FIG. 3*a* is a schematic diagram of an embodiment of the dual mode DC power supply system shown with an unregulated DC input in accordance with the present invention.
Figure 3B:
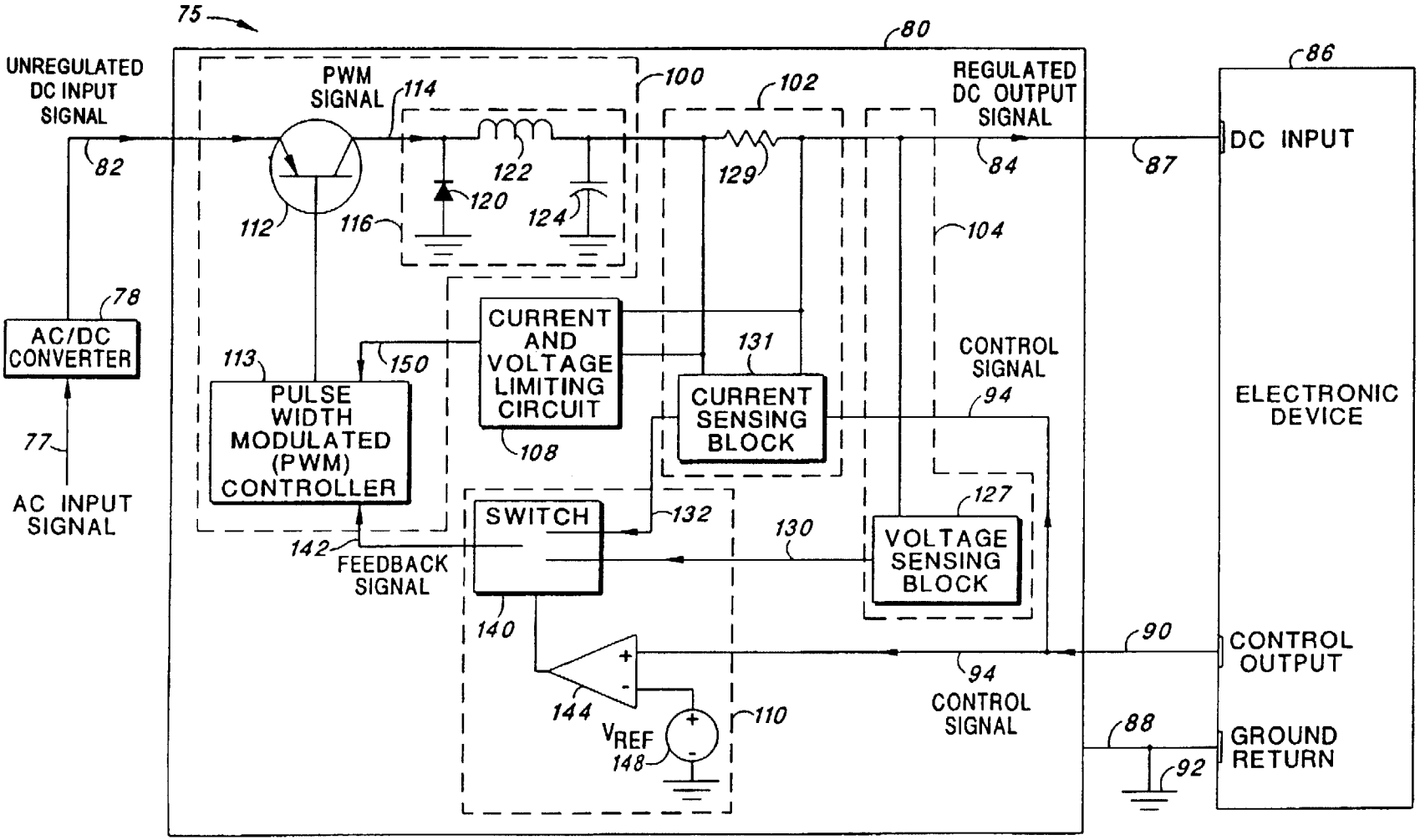
FIG. 3*b* is a schematic diagram of an embodiment of the dual mode DC power supply system shown with an AC input in accordance with the present invention.

Referring to FIGS. 3*a* and 3*b*, a schematic diagram is shown of a dual mode DC power supply system 75 for supplying DC power to an electronic device. In accordance with one embodiment of the present invention, shown in FIG. 3*a*, the dual mode DC power supply system 75 is a DC/DC power supply system with the input being an unregulated DC input signal 82. In accordance with another embodiment of the present invention, shown in FIG. 3*b*, the DC power supply system 75 is an AC/DC power supply system with the input being an AC input signal 77 which is input to an AC to DC converter 78 that produces the unregulated DC input signal 82.

Shown in both embodiments (FIGS. 3*a* and 3*b*) is a dual mode DC power supply module 80 adapted to receive an input signal 82 of unregulated DC power and provide a regulated DC output signal 84 to an electronic device 86. The electronic device 86 and power supply module 80 are coupled together with a plurality of conductors 87, 88, and 90. The first conductor 87 provides the DC output signal 84 (either constant voltage or constant current) to the electronic device 86 while the second conductor 88 provides a coupling of the power supply module 80 and electronic device 86 to a ground potential 92. The third conductor 90 is a single conductor coupling the electronic device 86 with the power supply module 80 and over which a control signal 94 passes. As discussed in more detail below, the control signal 94 is used to selectively control the mode of the power supply module 80. In other words, depending upon the voltage level of the control signal 94, the power supply module 80 operates in either a constant voltage mode to power the electronic device 86 or a constant current mode to recharge the batteries in the electronic device 86. The control signal 94 is also used as a reference input to the power supply module 80 to adjust the level of constant current that is delivered to the electronic device 86 when the power supply module 80 is operating in the constant current mode.

The illustrated DC power supply module 80 includes a regulating circuit 100, a current sensing circuit 102, a voltage sensing circuit 104, a current and voltage limiting circuit 108, and a mode switching circuit 110. The preferred embodiment of the regulating circuit 100 includes a series switch transistor 112 that is adapted to receive the input signal 82 of unregulated DC power, a pulse width modulated controller 113 connected to the base of the series switch transistor 112 and adapted to condition the input signal 82 into a pulse width modulated (PWM) signal 114, and a filtering circuit 116 connected to the series switch transistor 112 and adapted for rectifying the pulse width modulated signal 114 into the DC output signal 84 for delivery to the electronic device 86. The filtering circuit 116 includes diode 120, inductor 122, and capacitor 124, whose arrangement and operating characteristics are selected to deliver the regulated DC output signal 84 from the pulse width modulated signal input as is well known in the art.

The current and the voltage of the regulated DC output signal 84 from the filtering circuit 116 is then measured using a current sensing circuit 102 and voltage sensing circuit 104, respectively. The voltage sensing block 127 of the voltage sensing circuit 104 is adapted to measure the voltage delivered to the electronic device 86 and provide a first feedback signal 130, based on that measured voltage, to the pulse width modulated controller 113. In response to the feedback signal, the pulse width modulated controller 113 adjusts the on/off duty cycle of the switching transistor 112 to alter the pulse width modulated signal 114. However, the first feedback signal 130 is forwarded to the pulse width modulated controller 113 only if the power supply module 80 is operating in a constant voltage mode.

Similarly, the current sensing circuit 102 is adapted to measure the level of current across a current sensing resistor 129 through which the DC output signal 84 passes. Based on the current measures across the current sensing resistor 129, a current sensing block 131 generates a second feedback signal 132 which is forwarded to the pulse width modulated controller 113. It is important to note that the second feedback signal 132 is forwarded to the pulse width modulated controller 113 only if the power supply module 80 is operating in a constant current mode. The current sensing block 131 also receives as an input the control signal 94 which is indicative of the level of constant current the power supply module 80 should be delivering to the electronic device 86. Upon receipt of the second feedback signal 132, the pulse width modulated controller 113 adjusts the pulse width modulated signal 114 accordingly.

The mode switching circuit 110 comprises an analog switch 140 adapted to select either the first feedback signal 130 originating from the voltage sensing block 127 or the second feedback signal 132 originating from the current sensing block 131 and pass a single selected feedback signal 142 to the pulse width modulated controller 113. The analog switch 140 is operatively connected to a comparator circuit 144 which compares the voltage of the control signal 94 and a reference voltage, $V_{REF}$ 148 in order to determine the mode of operation for the power supply system 75. When the dual mode power supply system 75 is operating in the constant voltage mode, the mode switching circuit 110 is functioning so as to use the first feedback signal 130, originating from the voltage sensing block 127, as the feedback signal 142 to the pulse width modulated controller 113. Conversely, when the dual mode power supply system 75 is operating in the constant current mode, the mode switching circuit 110 is operating in a manner that uses the second feedback signal 132, originating from the current sensing block 131, as the feedback signal 142 to the pulse width modulated controller 113. The selection of which feedback signal to couple with the pulse width modulated controller 113 is governed the magnitude of the control signal 94 as determined with the comparator circuit 144. As indicated above, the control signal 94 is also used as a reference input to the current sensing block 131 in order to adjust the level of constant current that is delivered to the electronic device 86 when the power supply system 75 operates in the constant current mode.

The illustrated power supply module 80 also includes a current and voltage limiting circuit 108 coupled to the current sensing circuit 102. The current and voltage limiting circuit 108 is adapted to provide a limiting signal 150 to the pulse width modulated controller 113 in the event of an over-current or an over-voltage condition, in a manner that is well known in the art.

Figure 4:
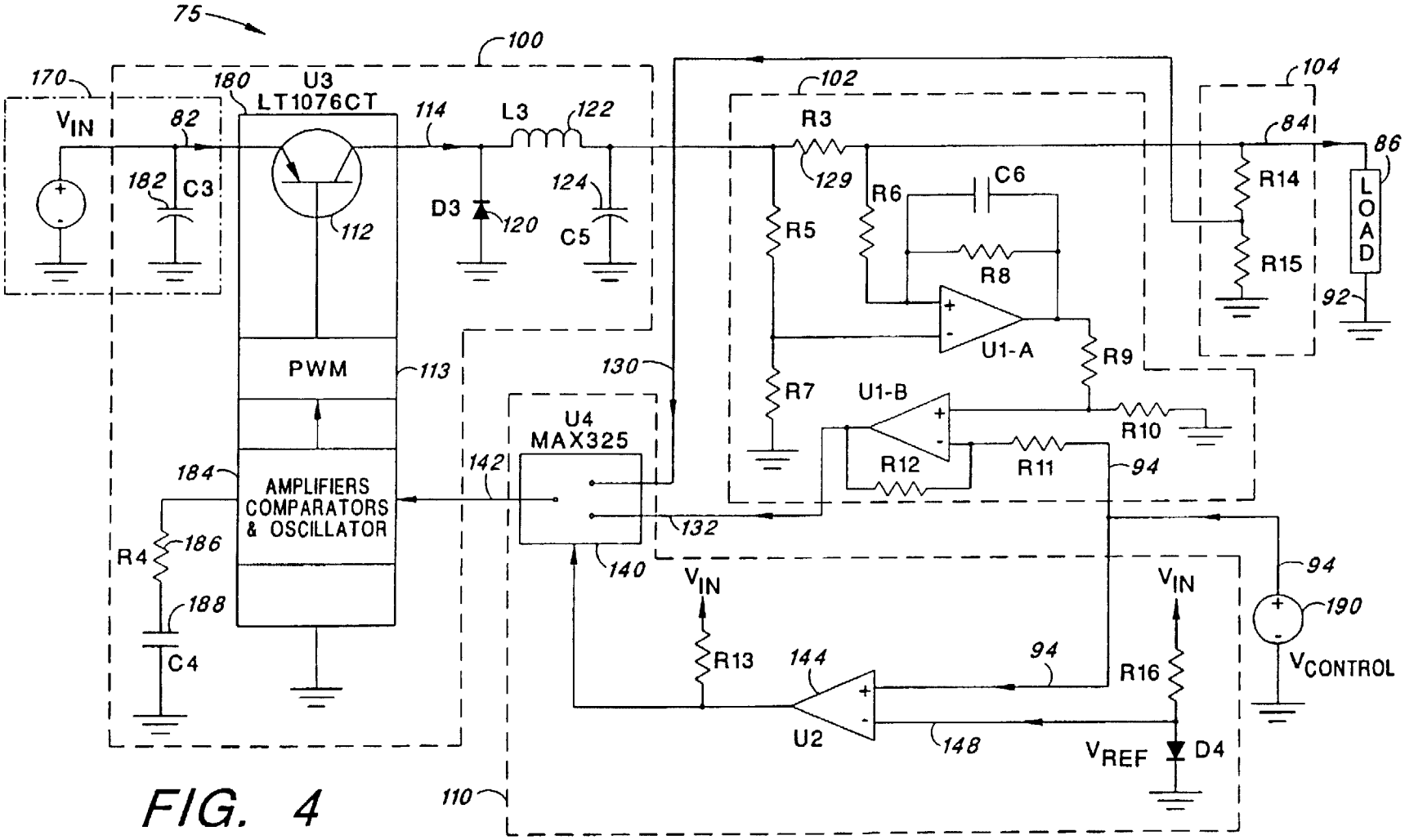
FIG. 4 is a more detailed circuit diagram of the dual mode DC power supply system of FIGS. 3*a* and 3*b*.

Turning next to FIG. 4, there is shown a detailed schematic of one example or prototype of the power supply system of FIGS. 3*a* or 3*b*. As seen therein, the dual mode DC power supply system 75 is adapted to drive an electronic load 86 having variable DC resistance. The illustrated DC power supply system 75 includes a DC voltage source 170, regulating circuit 100, a current sensing circuit 102, a voltage sensing circuit 104, a current and voltage limiting circuit, and a mode switching circuit 110. The regulating circuit 100 is comprised of an integrated circuit 180 containing the series switch transistor 112, the PWM controller 113, and the necessary amplifiers, comparators and oscillator (collectively identified as 184) adapted for processing a feedback signal 142 in a manner necessary to condition the input signal 82 into a pulse width modulated signal 114. As described above, with reference to FIGS. 3*a* and 3*b*, the regulating circuit 100 also includes diode 120, inductor 122, and capacitor 124 arranges so as to rectify the pulse width modulated signal 114 into the DC output signal 84 for delivery to the variable resistance load 86. The regulating circuit 100 further includes additional components including a resistor 186 and capacitor 188 coupled to the integrated circuit 180.

The preferred embodiments of the current sensing circuit 102, the voltage sensing circuit 104 as well as the current and voltage limiting circuits are further illustrated in FIG. 4. While these circuit layouts represent the presently known best mode for practicing the invention, it is anticipated that numerous changes or modifications may be made in the form, construction and arrangement of these circuits. The exact specifications and designs of these aforementioned circuits are very much dependent on the application in which the power supply system is used.

The mode switching circuit 110, shown in FIG. 4, includes an analog switch 140 adapted to select either the first feedback signal 130 originating from the voltage sensing circuit 104 or the second feedback signal 132 originating from the current sensing circuit 102. The output of the analog switch 140 is a feedback signal 142 which is forwarded to the integrated circuit 180. The mode switching circuit further includes a control signal 94 input, a reference voltage input 148, and a comparator circuit. As indicated earlier, the analog switch 140 is operatively connected to a comparator circuit 144 which compares the voltage of the control signal 94 and a reference voltage, $V_{REF}$ in order to determine the mode of operation for the power supply system 75. When the dual mode power supply system 75 is operating in the constant voltage mode, the mode switching circuit 110 is functioning so as to use the first feedback signal 130, originating from the voltage sensing circuit 104, as the feedback signal 142 to the integrated circuit 180. Conversely, when the dual mode power supply system 75 is operating in the constant current mode, the mode switching circuit 110 is operating in a manner that uses the second feedback signal 132, originating from the current sensing circuit 102, as the feedback signal 142 to the integrated circuit 180. The selection of which feedback signal to couple with the integrated circuit 180 is determined by the voltage level associated with the control signal 94 as determined with the comparator circuit 144 using a prescribed reference signal $V_{REF}$. In the illustrated embodiment, the control signal 94 is generated from a DC voltage supply 190 which may or may not be associated with the electronic device 86.

The embodiment illustrated in FIG. 4 was tested to determine the usefulness of the embodiment in various mobile communication electronic devices. Table 1, provides a summary of the test results using a variable load resistance and a control signal output ranging between 0.0 volts to 4.40 volts.

TABLE 1

| Control Signal Voltage | Operating Mode | Input Signal Voltage | Output Signal Voltage | Load | Output Signal Current |
|---|---|---|---|---|---|
| 0.0 V to 0.6 V | Constant Voltage | 12.0 V | 8.11 V | ∞ | 0.0 A |
| 0.0 V to 0.6 V | Constant Voltage | 12.0 V | 8.01 V | 16 Ω | 0.5 A |
| 0.0 V to 0.6 V | Constant Voltage | 12.0 V | 7.84 V | 7.84 Ω | 1.0 A |
| 0.65 V | Constant Current | 12.0 V | 2.00 V | 10 Ω | 200 mA |
| 0.65 V | Constant Current | 12.0 V | 0.81 V | 4 Ω | 203 mA |
| 1.00 V | Constant Current | 12.0 V | 2.80 V | 10 Ω | 280 mA |
| 1.00 V | Constant Current | 12.0 V | 1.18 V | 4 Ω | 295 mA |
| 2.00 V | Constant Current | 12.0 V | 5.34 V | 10 Ω | 534 mA |
| 2.00 V | Constant Current | 12.0 V | 2.15 V | 4 Ω | 538 mA |
| 3.00 V | Constant Current | 12.0 V | 7.73 V | 10 Ω | 773 mA |
| 3.00 V | Constant Current | 12.0 V | 3.10 V | 4 Ω | 775 mA |
| 4.00 V | Constant Current | 12.0 V | 9.80 V | 10 Ω | 980 mA |
| 4.00 V | Constant Current | 12.0 V | 4.04 V | 4 Ω | 1010 mA |
| 4.40 V | Constant Current | 12.0 V | 10.15 V | 10 Ω | 1015 mA |
| 4.40 V | Constant Current | 12.0 V | 4.39 V | 4 Ω | 1098 mA |

As can be seen from the results of Table 1, when the control signal voltage remains below 0.6 volts, the power supply system operates in a constant voltage mode. The constant voltage associated with the output signal is regulated (e.g. between 8.11 V and 7.84 V) while the output current varies from 0.0 amps to 1.0 amps. However, as soon as the magnitude of control signal reaches 0.65 volts, the power supply system changes modes and operates in a constant current mode. As the voltage of the control signal rises from 0.65 V to 4.40 V, the regulated output current goes up. For any given control signal voltage, the output current remains approximately constant notwithstanding a change in the load resistance.

It is thus apparent that the present invention provides a simple and inexpensive dual mode DC power supply system that can operate in a constant current mode as well as a constant voltage mode, and more importantly, is adapted to operate under the control of the electronic device being powered.

The present invention and its advantages will be understood from the foregoing description, and it will be apparent that numerous modifications and variations could be made thereto without departing from the spirit and scope of the invention or sacrificing all of its material advantages, the forms hereinbefore described being merely exemplary embodiments thereof.

To that end, it is not intended that the scope of the invention be limited to the specific embodiments illustrated and described. Rather, it is intended that the scope of the invention be determined by the appended claims or their equivalents.

What is claimed is:

1. An electronic system comprising:

an external DC power supply system comprising:

an AC to DC converter;

a control signal input; and a regulating circuit coupled to the AC to DC converter and to the control signal input, the regulating circuit including a DC power output, and generating a DC output signal at the DC power output in response to unregulated DC power from the AC to DC converter and a control signal from the control signal input, the regulating circuit including:

a switching circuit coupled to the control signal input, for operating the regulating circuit in a constant voltage mode in the event a magnitude of the control signal is within a first prescribed range, and for operating the regulating circuit in a constant current mode in the event the magnitude of the control signal is within a second prescribed range, and for selecting a selected level of constant current, in the event the regulating circuit is being operated in the constant current mode, as a function of the magnitude of the control signal within the second prescribed range; and a portable electronic device comprising:

a control signal output detachably coupled to the control signal input of the external DC power supply system, for providing the control signal to the control signal input; and a DC power input detachably coupled to the DC power output of the external DC power supply system.

2. The DC power supply system of claim 1 further comprising means for limiting a voltage of said DC output signal to a prescribed maximum voltage.

3. The DC power supply system of claim 1 wherein said regulating circuit further comprises:

a series switch transistor coupled to said AC to DC converter for receiving said unregulated DC power;

a pulse width modulated controller coupled to the series switch transistor, for conditioning said unregulated DC power into a pulse width modulated signal; and a filtering circuit coupled to said series switch transistor, for rectifying said pulse width modulated signal into said DC output signal.

4. The DC power supply system of claim 1 further comprising means for limiting a current of said DC output signal to a prescribed maximum current.

5. The DC power supply system of claim 4 further comprising means for limiting a voltage of said DC output signal to a prescribed maximum voltage.

6. The DC power supply system of claim 1 wherein said regulating circuit further includes:

a voltage sensing circuit coupled to said DC power output, for sensing a voltage of said DC output signal and providing a voltage feedback signal; and a current sensing circuit coupled to said DC power output, for sensing a current of said DC output signal and providing a current feedback signal;

wherein said switching circuit operates said regulating circuit in said constant voltage mode in response to the voltage feedback signal, and wherein said switching circuit operates said regulating circuit on said constant current mode in response to the current feedback signal.

7. The DC power supply system of claim 14 wherein said switching circuit further comprises a switch responsive to said control signal for coupling said voltage feedback signal to said regulating circuit when said regulating circuit is operating in said constant voltage mode and for coupling said current feedback signal to said regulating circuit when said regulating circuit is operating in said constant current mode.

8. The DC power supply system of claim 7 wherein said switching circuit comprises a comparator circuit coupled to said switch, for comparing said control signal to a reference voltage.

9. The DC power supply system of claim 8 wherein said control signal is coupled to said current sensing circuit and wherein said regulating circuit generates said DC output signal in response to said current feedback signal when said regulating circuit is operating in said constant current mode.

* * * * *